United States Patent [19]

The

[11] Patent Number: 4,732,352

[45] Date of Patent: Mar. 22, 1988

[54] KITE STRING SLIDER

[76] Inventor: Jacob K. The, 323-810 W. Broadway, Vancouver, B.C., Canada, V5Z 1J8

[21] Appl. No.: 921,244

[22] Filed: Oct. 21, 1986

[30] Foreign Application Priority Data

Oct. 24, 1985 [CA] Canada ..... 493794

[51] Int. Cl.[4] ..... B64C 31/06; A63H 27/08

[52] U.S. Cl. ..... 244/155 R

[58] Field of Search ..... 244/155 R

[56] References Cited

U.S. PATENT DOCUMENTS

| | | | |
|---|---|---|---|
| 2,785,871 | 3/1957 | Flint et al. | 244/155 R |
| 3,968,948 | 7/1976 | Schmidt | 244/155 R |
| 4,240,600 | 12/1980 | Urasaki | 244/155 R |

*Primary Examiner*—Joseph F. Peters, Jr.
*Assistant Examiner*—Rodney Corl
*Attorney, Agent, or Firm*—Jacob K. The

[57] ABSTRACT

A toy accessory for a kite comprises a slider intended to ride up the string of an airborne kite. The slider comprises a frame (3, 4, 5, 6) intended to be suspended from the kite string by pig-tail eyelets (7, 41). The front eyelet (41) forms the trigger of a latch mechanism including a cranked wire element having an intermediate limb (43) slidable longitudinally in holes (15, 8) in the frame, and a sear (46) slidable in hole (9) in the frame. The sear (46) latches a lever (27) in the position shown, in which it holds a pair of pivoted wings (1) in their operative spread position via ties (47), and, via a spring (26), holds a pivoted clip (23) in its uppermost position to trap a folded toy parachute between the frame member (5) and the clip (23). The slider is propelled up the kite string by wind pressure acting on the wings, until the front eyelet (41) strikes a stop on the kit string. This causes the wire element, and therefore the sear (46), to slide back, the lever (27) is released to pivot anti-clockwise, permitting the wings (1) to pivot forward to a folded position under the effect of an elastic band (40), and releasing the spring (26), allowing the clip (23) to hinge down and release the parachute. With the wings folded, the slider slides back down the kite string. The slider is then reloaded, and the latch mechanism reset, ready for a further ascent.

24 Claims, 6 Drawing Figures

KITE STRING SLIDER

DESCRIPTION

The present invention relates to an accessory for a kite, which comprises a carrier in the form of a slider or rider which is intended to travel up and down the string of an airborne kite, and to carry a toy parachute, small piece of paper or other article, which is automatically released when the carrier reaches a certain height.

More particularly, the invention relates to a carrier which basically comprises a body or frame carrying a movable wing arrangement, an article-support arrangement, a latch arrangement, and a carrier-suspension arrangement. During ascent, the wing arrangement is spread or otherwise operative to catch the wind and thus propel the carrier up the kite string, supported by the suspension arrangement. When the carrier reaches a release point determined by a stop on the string, a trigger associated with the latch arrangement strikes the stop, which actuates, i.e. releases, the latch arrangement. This causes the article-support arrangement to release the parachute or other article, and also causes the wing arrangement to fold or otherwise become inoperative so as to permit the carrier to travel back down the string.

Carriers of this general type are disclosed in U.S. Pat. Nos.: 2,473,213, 2,535,165, 2,785,871, 3,105,663, 3,960,347 and 3,968,948.

Carriers of this general type are subject to various conflicting design requirements. For example, the carrier should be as light as possible, i.e. the weight and number of its components should be minimized, with a view to enabling the carrier to be effectively used over a wide range of wind strengths, not only with relatively large kites, but also with small or medium size kites more suitable for handling by children. On the other hand, the carrier and its components should be sufficiently robust to withstand normal handling and use.

Furthermore, the components should be of a simple design and construction, and simple to assemble, to minimize manufacturing costs. On the other hand, the components should be designed with a view to reliability and consistency of operation; for example the latch arrangement should not fail to release when the carrier reaches the release point, and should not be prone to premature release, for example by knots or other irregularities associated with the kite string encountered by the carrier as it ascends towards the release point.

The latch trigger of each of the carriers disclosed in the above U.S. patents extends forwardly of the carrier suspension arrangement in the ascent direction of the carrier. Presumably with a view to minimizing the risk of premature release, the trigger is intended to be positioned adjacent, but spaced from the kite string during ascent. However, no account is taken of the fact that, under operating conditions, the string will be deflected or angled by a variable and significant amount where it emerges from the forward end of the suspension arrangement, due, for example to such variable factors as the tension in and inclination of the string, the weight of the carrier and its load, and the strength of the wind. As a result, during ascent, the portion of the string in front of the suspension arrangement may be angled towards the trigger and accidentally frictionally engage or snag the trigger with sufficient force to prematurely release the latch arrangement. Alternatively, the latter string portion may be angled away from the trigger to an extent that the trigger misses the stop, and the latch arrangement fails to release.

It is an object of the present invention to provide a carrier in the form of a slider which mitigates of effectively overcomes the foregoing disadvantage.

From one aspect, the present invention provides a slider for ascending and descending the string of an airborne kite or the like, comprising: a frame; two wings pivotally connected to the frame for movement between an operative position in which they are mutually spread apart on opposite sides of the frame, and an inoperative folded position; wing-biasing means to resiliently bias the wings towards their inoperative folded position; support means for supporting a parachute or other article to be released from the slider, the support means being connected to the frame and movable between an operative, article-support position and an inoperative, article-release position; and latch means including an element of wire or the like connected to the frame for displacement between a latching condition in which the wings and support means are retained in their operative positions, and an unlatching condition in which the wings and support means are released to move to their inoperative positions, the wire element being provided with a trigger member including a loop forming suspension means for slidably suspending the slider from a kite string, and being provided with a latch member, the wire element being displaceable from its latching to its unlatching condition when the suspension loop engages an obstruction associated with the string of an airborne kite, whilst slidably suspending the slider from the string, as the slider ascends the string, means being provided to resist inadvertent displacement of the wire element from its latching to its unlatching condition.

Since the loop of the trigger member intentionally slidably cooperates with the string, it cannot fail to strike the obstruction or stop when the slider ascends to the release point, whilst the value of the restraining force exerted on the wire element by the displacement-resisting means is large enough to effectively minimize the risk of premature unlatching or release, under normal operating conditions, when the loop strikes the stop. Furthermore, since the loop serves the dual purpose of a trigger, and a suspension member for the slider, a separate suspension member in the vicinity of the loop is not required, thus saving weight.

Another disadvantage of the prior carriers disclosed in U.S. Pat. Nos.: 2,535,165 and 3,968,948, in which the latch arrangement comprises a wire element having a free end portion which forms a sliding bolt or latch, is that the latch directly supports the parachute and directly cooperates with the ties or equivalent which are anchored to the wing arrangement and which control the movement of the wing arrangement between its operative spread position and its inoperative folded position. This necessitates the provision of plural spaced bearings for the latch, which increase the weight and complicates the carrier. It also necessitates the latch sliding a considerable distance before releasing both the wing arrangement and the parachute. However, this considerable sliding distance, which is also provided in an attempt to minimize premature release, possesses the disadvantage that it increases the risk of the latch failing to release or, release completely, when the trigger strikes the stop.

This disadvantage is overcome, in one embodiment of the invention, by providing a control lever pivotally connected to the frame, which is operable, effectively simultaneously, to control the operation of the wings and parachute-or article-support means. The control lever, in a first pivoted position corresponding to the operative positions of the wing and article-support means, cooperates with and is latched by the tip of the free end portion of the wire element, which form a sear. Thus, only minimal movement of the sear is necessary in order to unlatch the control lever. Furthermore, the restraining force which serves to minimize premature unlatching of the sear may comprise the frictional force with which the control lever cooperates with the sear. The restraining force may be generated by the wing-biasing means and/or a spring which also serves to couple the article-support means to the control lever when the latter is latched in its first pivoted position by the sear. Thus, the value of the restraining force may be controlled and designed into the slider.

An additional advantage of the control lever is that the slider may be simply set in its operative condition by pivoting the control lever into its latched first pivoted position, since this automatically displaces the wings and article-support means to their operative positions.

A further disadvantage of some of the prior carrier is that the effect of the wind pressure, and variations in the wind pressure, acting on the wing arrangement is transmitted to the latch arrangement by the wing-control ties, uncontrollably increasing the resistance to release of the latch arrangement. This disadvantage is overcome in the slider embodying the invention, in which, in the operative spread condition of the wings when the control lever is latched in its first pivoted position, the wing-control ties define, with a line intersecting the control lever pivot axis and the connection of the ties to the control lever, a relatively small acute included angle. Thus, variations in the tension in the ties due to variations in wind pressure acting on the wings do not significantly affect the predetermined or controlled frictional retaining force exerted by the control lever on the sear.

The acute angle may be significantly less than 45°, for example within the range of 20° to 30°, and more particularly, of the order of 25°.

There are numerous other significant advantages possessed by the slider embodying the invention which are not possessed by the prior carriers.

One of these results from the provision of a relatively deep, thin, flat openwork frame, i.e. a generally planar frame with its plane disposed vertically in the longitudinal direction of travel of the slider. This enables the centre of gravity of the suspended slider and its load to be kept well below the kite string, which stabilizes the slider, rendering it less prone to swinging or rotating about the string.

Another advantageous feature is that the pivotal axis of the wings is so disposed that the plane of the wings, when in their operative spread position, and when the slider is ascending an inclined kite string, is generally vertical, not perpendicular to the kite string as in prior carriers. Thus, firstly, the plane of the wings is approximately perpendicular to the wind direction, thereby obtaining the maximum drive from the wind. Secondly, the plane of the wings is inclined downwardly and forwardly, relative to the kite string, and relative to the longitudinal axis of the slider, or at least the suspension means thereof, thereby further improving the stability of the slider.

A further advantageous feature is that the frame is relatively thin, and the components carried by the frame do not project laterally of the frame to any significant extent (including the wings when folded). Thus, the slider possesses the advantage of minimum wind resistance during descent.

Another advantageous feature is the provision of rigid light wing holders by which the wings are pivotally connected to the frame. These holders are fixed to the roots of the wing elements so as to support and hold the wing surfaces or elements at the correct angle, and extend towards the wing tips to reinforce the wing elements, enabling the wing elements to be made from a relatively thin, light but stiff material, such as Expanded Polystyrene (EPS) or Styrofoam, without the need for a supporting framework surrounding the wing elements. The strain on the wing elements is minimized by coupling the wing-biasing means to the wing-control ties directly via the wing holders, and not via the wing elements.

Another advantageous feature is that the wings, at least where they are pivoted to the frame, do not extend below, or significantly below, the level of the article-support means. This effectively eliminates the risk of the parachute or other article, when released, becoming snagged on the wing elements or their holders.

A further advantageous feature is that the article-support means comprises a pivoted arm or platform which is capable of trapping the article, for example toy parachute, in a folded condition against the underside of the frame. This prevents the parachute from swinging whilst being transported by the slider, and therefore from becoming entangled with the slider and/or the kite string if the slider should swing violently from side to side, or rotate around the string, in gusty conditions. This arrangement also enables the parachute, when released, to drop well clear of the slider before opening, thus also avoiding entanglement. Furthermore, by using a spring acting between the control lever and support arm to urge the latter into its operative article-supporting position, the support arm will accommodate and effectively support one or more articles of varying overall thickness.

Yet another advantageous feature is that the control lever, article-support arm, and also the parachute or other article supported by the latter, are disposed longitudinally rearwardly of the suspension/trigger loop, in a region below a second suspension loop fixed to the rear of the frame. Thus the weight carried by the front trigger loop, and therefore the friction between the trigger loop and the string, which, during sliding ascent, acts in the unlatching direction of the trigger loop, is minimized.

In order that the invention may be more readily understood, one embodiment thereof will now be described with reference to the accompanying drawings, in which.

Figure 1:
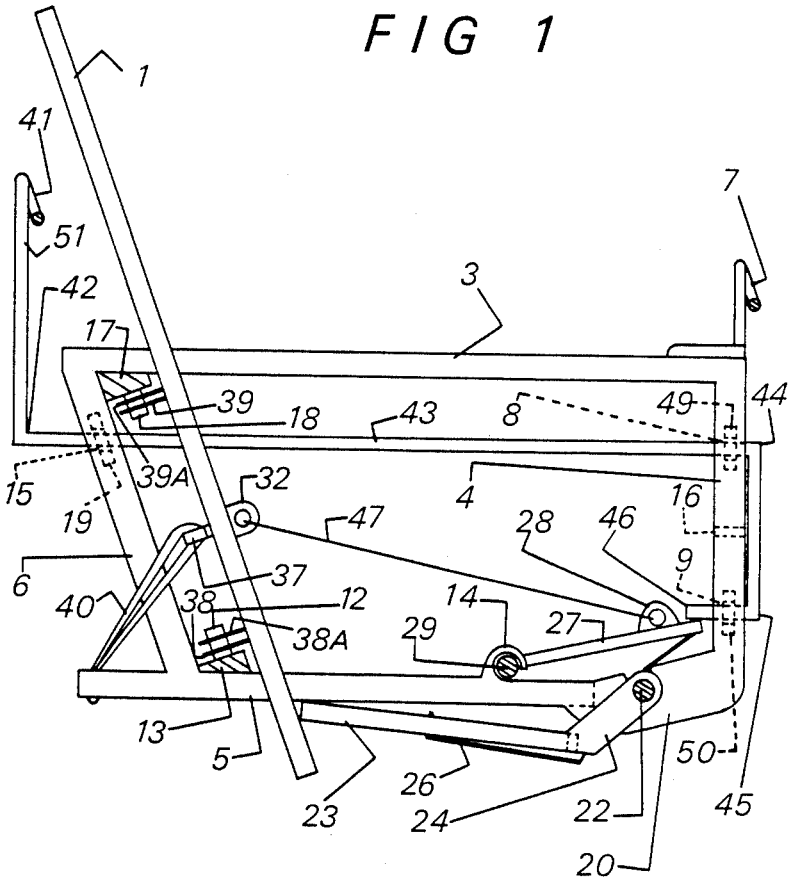
FIG. 1 is a side view of the kite string slider in its latched, operative or ascent condition with the wings spread to catch the wind.

In the description and appended claims, positional terms such as "front", "rear", etc. are to be construed as being relative to the intended direction of travel of the slider when ascending, which, as view in FIG. 1 for example, will be from right to left. Positional terms such as "top" and "bottom", etc. are to be construed as being relative to the position which the slider will assume when suspended, for example as shown in FIG. 1.

The slider illustrated comprises a unitary frame formed, for example moulded, from a synthetic plastics material.

The frame includes a top member 3 which is thickened at its rear end to anchor a wire or plastics loop 7. The loop 7, which forms one of a pair of suspension members, is in the form of a pig-tail eyelet, to enable it to be readily attached to or detached from a kite string (not shown). A plastics pad 17 serves as a base for a cylindrical plastics peg or boss 18 at the front end of the top member 3. The loop 7, pad 17 and peg 18 may be fixed to or formed integrally with the frame.

The frame also includes a rear member including two side-by-side thin frame parts 4 and 4A which are supported or braced, and interconnected, for example integrally interconnected, by thin transverse webs or struts 16, 49 and 50, the webs 49 and 50 having holes 8 and 9 respectively. The frame part 4A is aligned with and obscured behind the frame part 4 as viewed in FIGS. 1 and 5, but is visible in FIGS. 2 and 6.

Figure 2:
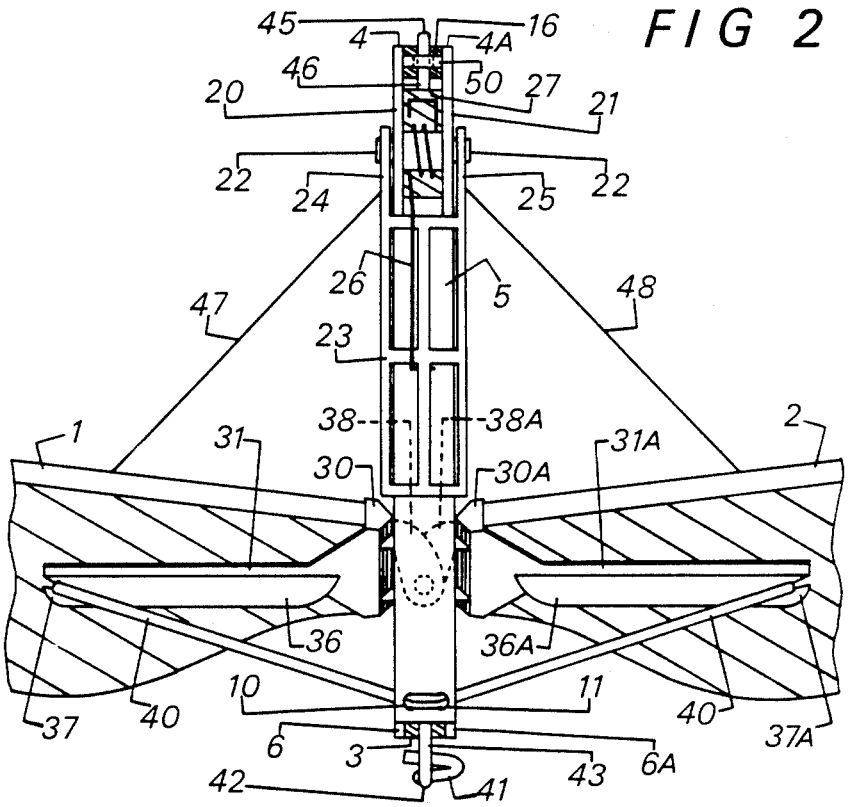
FIG. 2 is a fragmentary underneath view of the operative slider.
Figure 3:
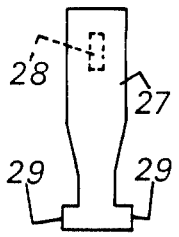
FIG. 3 is an underneath view of the control lever shown in FIGS. 1 and 2.

The frame further includes a bottom member 5 having a forward extension provided at its end with two side-by-side holes 10 and 11 (see FIG. 2). A plastics pad 13 serves as a base for a cylindrical plastics peg or boss 12, axially aligned with the upper peg 18. Two thin plastics hooks 14 are spaced apart-transversely at opposite sides of the frame member 5, towards the rear and on top of the latter. One of the hooks is aligned with and obscured behind the other, as viewed in FIGS. 1 and 5.

The frame also includes two upright, thin plate-like portions or webs 20 and 21 (see FIG. 2) at the rear of the bottom frame member 5, which are connected to the lower ends of the rear frame parts 4, 4A. Each connector portion 20, 21 is provided with an upwardly opening hole or slot to receive a plastics rod or shaft 22.

Figure 4:
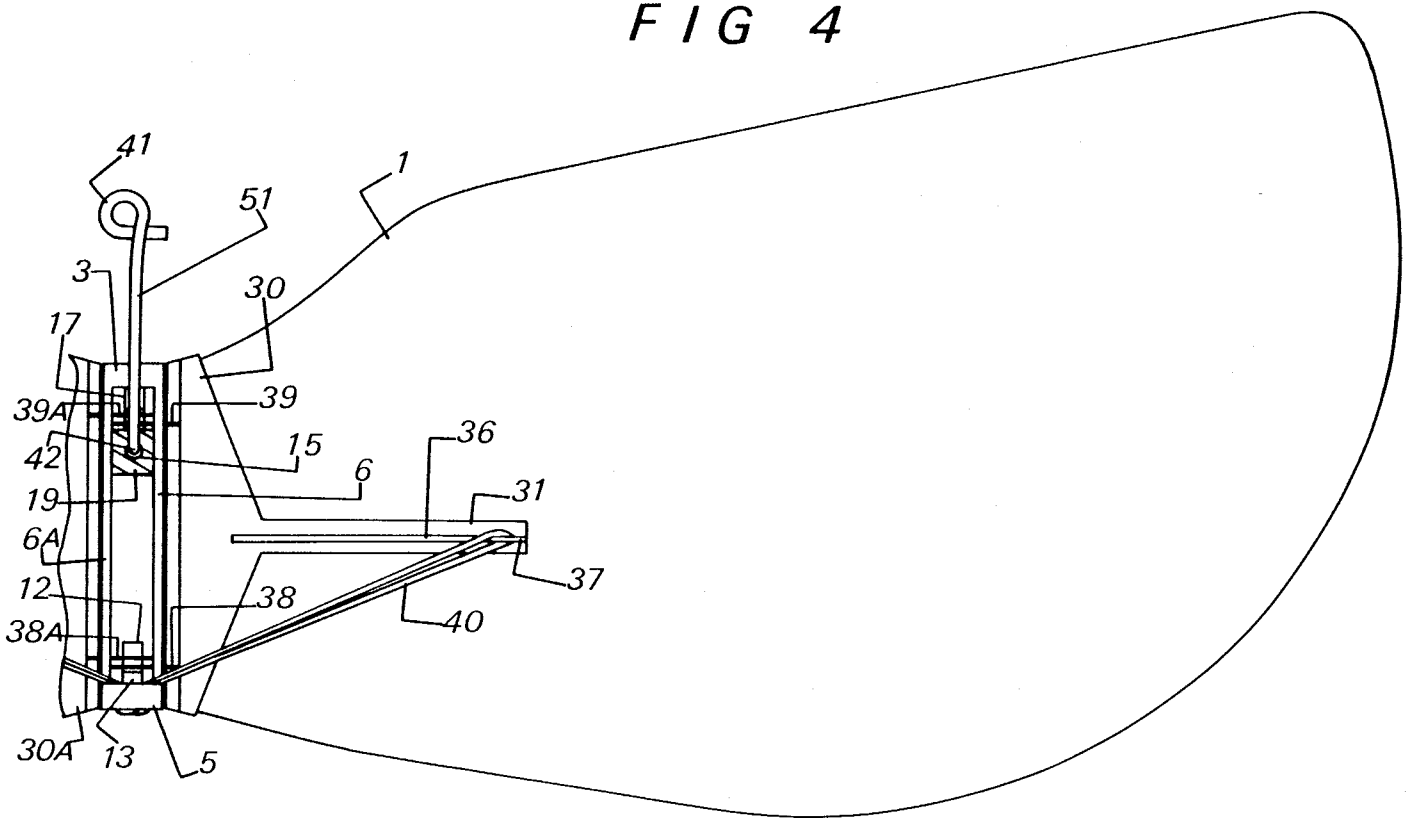
FIG. 4 is a fragmentary front view of the operative slider.

Finally, the frame includes a front member including two side-by-side thin frame parts 6 and 6A (see FIG. 4) which are supported or braced, and interconnected, by a thin transverse web or strut 19 having a hole 15. The frame parts 6, 6A serve as a barrier or stop between the wings, to be described later, so that, when unlatched, the wings can fold neatly to the desired forwardly extending position shown in FIG. 5.

To minimize slackening of the kite string when the slider is suspended from and slides along the string, the frame should be as light as possible, without detracting from the strength and durability of the frame. In this respect, as previously stated, each of the front and rear frame members consist basically of a pair of thin side parts interconnected by thin webs. Furthermore, the top and bottom frame members are hollow, for example generally H-shaped in cross-section with thin side limbs (visible in FIGS. 1 and 5) interconnected by a thin transverse limb (not shown). The ends of the top and bottom frame members are bridged by transverse reinforcing walls (visible in FIG. 4). The frame may be additionally reinforced if and where necessary (not shown).

The rod 22 is pushed or snapped downwardly into the upwardly opening slots in the connector portions 20, 21 to retain it in place. The rod 22 may be non-rotatably gripped in the slots, and is provided with an enlarged diameter middle portion (see FIGS. 2 and 6) located between the connector portions 20, 21 to prevent or restrict lateral movement of the rod relative to the frame.

Article-support means comprising an arm or clip 23 is positioned below the rear of the bottom frame member 5, and is pivotally mounted from the frame via the rod 22. For this purpose, the rear end of the clip 23 is formed integrally with a pair of thin plastics arms or lugs 24 and 25, each having a hole, which extend upwardly around opposite sides of the connector portions 20, 21 and are snapped over and fit loosely around, opposite laterally projecting ends of the rod 22. As shown in FIG. 2, the clip 23 is moulded in the form of a rectangular openwork frame to minimize its weight and wind resistance. Alternatively, the clip 23 could be formed from thin plastics, and reinforced on its underside by ribs or cross members, for example configured like the latter openwork frame. The support surface of the clip 23 and/or the underside of the bottom frame member 5 in the vicinity of the clip 23, may be roughened or otherwise formed to enhance the grip on any article clipped therebetween.

Figure 6:
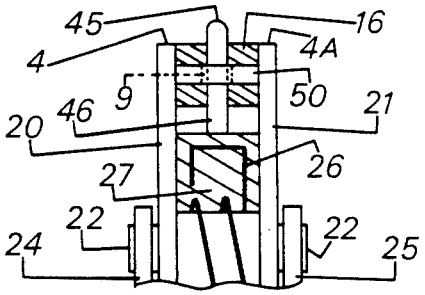
FIG. 6 is an enlarged fragmentary underneath view of the rear end of the slider shown at the top of FIG. 2.

A wire torsion spring 26 is located with its coils around the enlarged middle portion of the rod 22. The lower arm of the spring extends beneath the clip 23, and its free end is bent to extend around and grip the central frame member of the clip as shown in FIG. 2. The other arm of the spring 26 extends upwardly between the connector portions 20, 21, and its free end is bent into rectangular form as shown in FIGS. 2 and 6.

Above the clip 23 and bottom frame member 5 is mounted a thin plastics control lever 27. The control lever is provided at one end with a transverse, integral plastics rod or shaft 29, which snap-fits into the hooks 14 just loosely enough to enable the lever to pivot in the manner of a hinge. Close to its other end, the control lever 27 is formed with an integral lug or anchorage 28 provided with a hole.

Two wings are provided, comprising expansive wing elements 1 and 2 made of thin Expanded Polystyrene (EPS) or Styrofoam, although other light-weight stiff materials such as synthetic plastics materials may be used. The wings are designed generally like the wings of an eagle, although other designs like the wings of an aircraft, sails, or other wind-catching devices may be employed.

The wing element 1 is mounted in a plastics wing holder 30. In particular, the inner end or root of the wing element 1 adjacent the frame is glued and fitted into a slot in the wing holder which, as will be seen from FIG. 2 is sharp or V-shaped at its inner end, i.e. along its edge adjacent the frame. The wing holder 30 has a rectangular thin plastics strip 31 extending from the center of the slotted portion, towards the wing tip, lying along the front or leeward surface of the wing element. The strip 31 terminates at its outer end in a perpendicular projection or lug 32 which pierces or passes through the wing element 1 from the front thereof, and projects from the rear surface of the wing element to form an anchorage provided with a hole. The lug 32 is provided with two small U-shaped cuts (not shown) on opposite edges between the hole and the rear surface of the wing element 1, into which is dovetailed a thin plastics lock plate 34 provided with a central hole 35 joined by a slit 33 to the edge of the plate (see FIG. 5). The plate 34 may be held in place by a strip of adhesive tape (not shown). To prevent bending, the strip 31 is provided with a perpendicular stiffening rib 36, which terminates at its outer end in a hook 37. Thin plastics arms or lugs 38 and 39 are formed integrally with the opposite upper and lower ends of the sharp-ended slotted portion of the wing holder 30, each provided with a hole, which are snapped around respective pegs 12 and 18 so as to function like hinges, enabling the wings to spread and fold.

The other wing, i.e. the wing element 2 and holder 30A, is located on the opposite side of the frame and is to the same specification as the wing 1 previously described. For this reason, the other wing will not be described, and its components have been given the same reference numerals with the suffix "A".

Wing-biasing means comprising an elastic band, such as a rubber band 40, is threaded through the holes 10 and 11 and its opposite ends are looped around the hooks 37, 37A of the wing holders. The band 40 acts as a spring to urge both wings to their folded position, and keep them in this position, after unlatching of the latch means. Holes 10 and 11 may be replaced by plastics hooks or other anchorage(s) to hold the band 40 or one or more equivalent elastic elements, depending upon convenience of manufacture.

The latch means includes a cranked wire element slidable longitudinally in the frame. The front end of the wire element comprises a trigger member including a suspension/trigger loop 41 in the form of a pig-tail eyelet formed at the upper end of a vertical limb 51. The wire is bent at right angles at 42 to form a horizontal, longitudinal, straight, intermediate limb 43, and at its rear end is bent at right angles, downwardly at 44, and then forwardly at 45, to form a latch member. The lower forwardly and horizontally extending free end portion of the latch member forms a latch or sear 46 which is releasably cooperable with the edge of the control lever 27.

Figure 5:
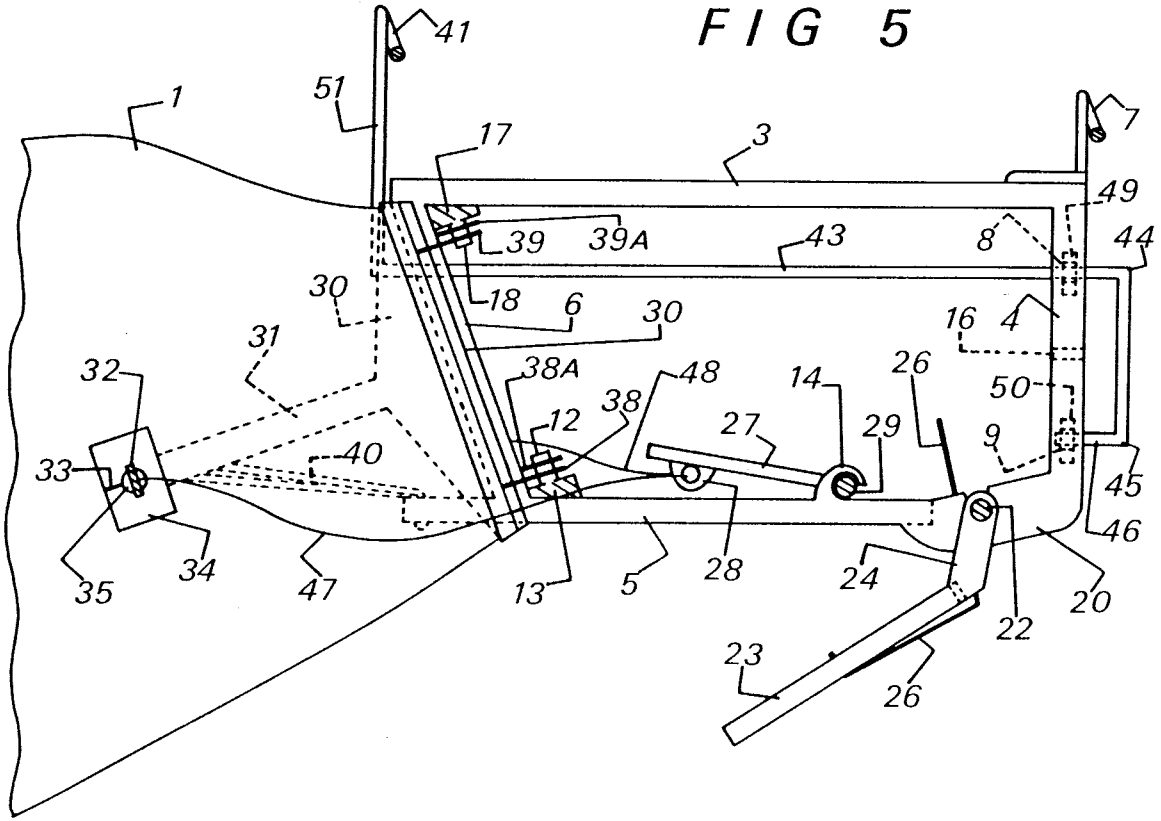
FIG. 5 is a fragmentary side view, similar to FIG. 1, but showing the slider in its unlatched, inoperative or descent condition with its wings folded.

The intermediate limb 43 is longer than the distance between the front and rear frame members 6, 6A and 4, 4A, to allow the front and rear end portions of the limb 43 to slide through the slightly larger holes 15 and 8, and to allow the sear 46 to slide through the hole 9. The front and rear vertical limbs of the wire elements are respectively cooperable with the top of the front frame member and web 16 of the rear frame member to limit the extent of the longitudinal sliding movement of the wire element, such that the sear 46 is slidably displaceable between a latching position in which it projects a short distance forwardly of the rear frame member 4, 4A just sufficient to latch over the control lever 27 as shown in FIG. 1, and an unlatching position in which it is retracted relative to the rear frame member as shown in FIG. 5, without becoming disengaged from the hole 9. The limited sliding movement also prevents the wire element, where it is bent at or adjacent the bends 42, 44 and 45, from engaging and possibly binding in the holes 15, 8 and 9.

The wire element may be a metal wire, plastics wire, or plastics coated wire, and is of sufficient thickness and stiffness to enable it to carry out its latching and unlatching functions without detrimental flexing or distortion.

Two ties, for example pieces of string or the like 47, 48, are connected between the apertured lug 28 of the control lever 27 and the apertured lugs 32, 32A of the respective wing holders 30, 30A, and provide means for spreading the wings when the control lever is manually rocked clockwise from its unlatched FIG. 5 position to its latched FIG. 1 position.

As shown in FIGS. 1 and 5, the front suspension/trigger loop 41 is higher than the rear fixed suspension loop 7 with respect to the top frame member 3. In addition, the pegs 12, 18 are positioned so that the common pivotal axis of the two wings is inclined relative to the top and bottom frame members 3 and 5. With this arrangement the wing surfaces will be disposed generally vertically, or nearer to the vertical, when the wings are spread during ascent of the slider along the inclined string of an airborne kite, so as to obtain the maximum benefit from the force of the wind.

By forming the suspension loops 41 and 7 as pig-tail eyelets, the slider may be readily attached to and detached from a kite string, and the eyelets permit the slider to slide freely up and down the string. However, the configuration of the eyelets is such that the slider cannot become unintentionally detached from the string, during use, for example if the slider should swing or rotate about the string in gusty conditions.

The design and configuration of the wing elements 1, 2, holders 30, 30A, clip 23, control lever 27 and the frame, are such that as the carrier is not only capable of sliding smoothly up a kite string when in its operative condition, with the wings spread, but is also capable of sliding smoothly back down the string when in its inoperative condition with the wings folded, irrespective of the wind strength. In the latter respect, the thin openwork configuration of the front and rear frame members and clip, and the sharp leading edges of the wing holders, minimize wind resistance and permit a smooth and rapid descent, even in strong winds.

The kite slider hereinbefore described is operated as follows:

1. A plastics toy parachute (not shown) is folded and clipped, together with the parachute weight, between the clip 23 and frame, by turning the control lever 27 clockwise towards the rear frame member 4, 4A, from its FIG. 5 position to its FIG. 1 position. This action presses down on, and deflects clockwise, the rectangular end of the upper arm of the spring 26, pushing up the lower end of the spring, and torsionally deflecting the spring so that the clip 23 is pushed up to resiliently grip the parachute. Simultaneously, the strings 47, 48 are pulled by the control lever 27, pivotally spreading both wings 1 and 2 to their desired operative position, and stretching the rubber band 40 via the wing holders 30, 30A. The wire element is slide from right to left to extend the sear 46 and latch it over the control lever 27.

As will be seen from FIG. 1, the string 47 (and therefore the string 48) makes a relatively small acute included angle (for example approximately 25°), with the control lever 27 so that the tension in the strings 47, 48 exerts a correspondingly relatively small turning force on the control lever. The turning force, primarily due to the stretched band 40, urges the control lever upwardly into frictional engagement with the sear 46. This turning force is supplemented by the torsionally deflected spring 26. Thus, by suitable choice of the band 40 and spring 26, the frictional cooperation between the control lever 27 and sear 46 can be controlled or pre-set, thereby predetermining the force required to slide the wire element from its latched position (FIG. 1) to its unlatched position (FIG. 5). The effect of the additional variable component of this force, resulting from the wind pressure acting on the wings, will be mitigated due to the afore-mentioned acute angle configuration.

2. A stop, for example a 2 cm long plastics rod or stick, is attached to the kite string approximately 4 meters from the kite to serve as a release point. When the kite has reached the desired height determined by the operator, the slider is attached to the string by the loops 41, 7, with the loop 41 at the upper or leading end, and another plastics rod, stick, disc or other stop may be fastened to the string below the slider to prevent the slider from sliding down beyond that point. The rod or stick forming at least the top stop is preferably semi-circular or C-shaped so that, irrespective of the orientation it may assume relative to the string, the loop 41 will always be stopped by, and will not slide over, the stop.

The wind force acting on the spread wings propel the slider upwardly along the string, whilst the frictional restraining force applied to the sear 46 by the control lever 27 will prevent or resist unintentional rearward sliding of the wire element, and therefore prevent premature retraction and release of the sear 46, should the loop 41 encounter and ride over a knot or other irregularity during its sliding travel up the string. However, when the slider reaches the release point, the loop 41 strikes the stop, the frictional restraining force is overcome, the wire element slides rearwardly in the holes 15, 8 and 9 until the limb 51 strikes the front of the frame, and the sear 46 is retracted, unlatching the control lever 27. If the wind force alone is insufficient to overcome the frictional restraining force when the slider reaches the stop, release can be accomplished by pulling or jerking the kite string.

Once the sear 46 releases the control lever 27, as shown in FIG. 5, the lever is free to rotate anti-clockwise, and the tension in the rubber band 40 pulls and folds both wings 1 and 2 forwards. The control lever 27 releases the spring 26, allowing the clip 23 to rotate anti-clockwise and open automatically, and the folded parachute, and/or any other article(s) such as pieces of paper, baby kites, will be released and drop. With its wings folded, the slider will slide back down the string against the wind, to the lower stop, ready to be used again after re-setting the control lever and the wire latch element.

It will be understood that various modifications may be made without departing from the scope of the invention as defined in the appended claims. For example the size, shape or configuration of the frame, and/or of the other components, may be changed, as may be the materials from which they are formed.

The slider could be employed to release advertising material, leaflets, menus, etc. flying objects such as toy gliders or darts made, for example from paper or card, instead of or in addition to parachutes.

The upper stop may be omitted from the kite string, and the slider may be triggered by striking the interconnection, for example ring, swivel or the like, connecting the kite to the string. The stop at the lower end of the kite string may also be omitted.

The embodiment of the invention in which an exclusive property or privilege is claimed are defined as follows:

1. A slider for ascending and descending the string of an airborne kite or the like, comprising: a frame; two wings pivotally connected to the frame for movement between an operative position in which they are mutually spread apart on opposite sides of the frame, and an inoperative folded position; wing-biasing means to resiliently bias the wings towards their inoperative folded position; support means for supporting a parachute or other article to be released from the slider, the support means being connected to the frame and movable between an operative article-support position and an inoperative, article-release position; and latch means operable effectively simultaneously to release the wings and support means, to permit them to move towards their inoperative positions, said latch means including an element of wire or the like connected to the frame for displacement between a latching condition in which the wings and support means are retained in their operative positions, and an unlatching condition in which the wings and support means are released to move to their inoperative positions, the wire element being provided with a trigger member including a loop forming suspension means for slidably suspending the slider from a kite string, and being provided with a latch member, the wire element being displaceable from its latching to its unlatching condition when the suspension loop engages an obstruction associated with the string of an airborne kite, whilst slidably suspending the slider from the string, as the slider ascends the string, means being provided to resist inadvertent displacement of the wire element from its latching to its unlatching condition, said latch means further including a control lever pivotally connected to the frame and connected to the wings, the latch member, in the latching condition of the wire element, being cooperable with the control lever to latch it in a first pivoted position in which it retains the wings in their operative spread position, the latch member, in the unlatching condition of the wire element, releasing the control lever for pivotal movement permitting the wings to move to their inoperative folded condition under the influence of the wing-biasing means, the control lever, when in its first pivoted position, being cooperable with the support means to retain the latter in its operative, article-support position, and, when released, freeing the support means for movement to its inoperative, article-release position.

2. A slider as claimed in claim 1, wherein the latch member includes a sear which is slidably mounted with respect to a member of the frame for movement between a latching position in which a free end of the sear is intended relative to said frame member to latch the control lever in its first pivoted position, and an unlatching position in which the free end of the sear is retracted relative to the frame member and control lever to release the control lever.

3. A slider as claimed in claim 2, including resilient means to bias the control lever into engagement with the sear when in its latching position, to exert on the sear a frictional retaining force which tends to resist inadvertent sliding unlatching movement of the sear.

4. A slider as claimed in claim 3, wherein said resilient means includes or comprises the wing-biasing means.

5. A slider as claimed in claim 4, wherein the support means includes a support arm pivotally connected to the frame, and associated with a spring which cooperates with, and is subjected to a deflecting force by, the control lever when in its first pivoted position, to urge the support arm into, and retain it in, its operative, article-support position, the deflecting force being removed or reduced by movement of the control lever from its first pivoted position upon movement of the sear to its unlatching position, to permit the support arm to move under the influence of gravity to its inoperative, article-release position.

6. A slider as claimed in claim 5, wherein the control lever-biasing means includes or comprises the spring associated with the support arm.

7. A slider as claimed in claim 6, wherein the wire element includes a straight portion intermediate the trigger and latch members, mounted for axial sliding movement with respect to the frame in the fore-and-aft direction of the slider, the trigger member comprising an end portion of the wire element which is bent upwardly generally at right angles to the intermediate wire portion at the front end thereof relative to the intended orientation of the slider during ascent, and is formed into the suspension loop, the latch member comprising the opposite end portion of the wire element which is bent downwardly generally at right angles to the intermediate wire portion at the rear end thereof relative to the intended orientation of the slider during ascent, the lower end portion of the downwardly bent portion being bent forwardly, generally parallel to the intermediate wire portion to form said sear.

8. A slider as claimed in claim 7, wherein the frame comprises an openwork, generally flat, rectangular frame, the plane of which, in use of the slider, is generally upright and parallel to the direction of travel of the slider, the frame being formed from a synthetic plastics material including integral front, rear, top and bottom frame members relative to the intended orientation of the slider during ascent.

9. A slider as claimed in claim 8, wherein the intermediate wire portion is slidably journalled in and passes through upper regions of the front and rear frame members, with the wire end portions forming the trigger and latch members being disposed, respectively, forwardly of the front frame member and rearwardly of the rear frame member, and being cooperable with their adjacent frame members to limit the extent of the travel of the wire element between said unlatching and latching conditions, and wherein the sear is slidably journalled in and passes through the lower region of the rear frame member.

10. A slider as claimed in claim 9, wherein the loop of the trigger member is positioned adjacent and above the front end of the top frame member, so as to slidably suspend the front of the slider from a kite string, and wherein a further loop is fixed to the frame adjacent and above the rear end of the top frame member so as to slidably suspend the rear of the slider from the kite string.

11. A slider as claimed in claim 10, wherein the loops comprise pig-tail eyelets to facilitate attachment and separation of the slider with respect to a kite string.

12. A slider as claimed in claim 11, wherein the wings are connected to the control lever by ties which retain the wings in their operative spread condition when the control lever is latched in its first pivoted position, and define with a line intersecting the control lever pivot axis and the connection of the ties to the control lever, a relatively small acute included angle, whereby variations in the tension in the ties due to variations in wind pressure acting on the wings do not significantly affect the frictional retaining force exerted by the control lever on the sear.

13. A slider as claimed in claim 12, wherein the ties are formed from one or more lengths of string or other relatively inextensible elongate element.

14. A slider as claimed in claim 8, wherein the wings are pivotally connected to the frame at or adjacent the front thereof, and pivotable from their operative spread position, forwardly of the frame to their inoperative folded position.

15. A slider as claimed in claim 14, wherein the wings are pivotable about a common axis which is generally parallel to the planes of the wings, and which is inclined to define an acute included angle with an imaginary line intersecting the two loops, such that, when the slider ascends the string of an airborne kite, the plane of each of the operatively spread wings is generally vertical or approaches the vertical.

16. A slider as claimed in claim 15, wherein said common axis is defined by cylindrical pegs attached to or integral with the frame at or adjacent the intersection of the front frame member with the top and bottom frame members.

17. A slider as claimed in claim 16, wherein each wing includes a relatively rigid wing mount including lugs pivotally mounted on the pegs, and a holder to which a wing element is attached, the holder extending along the root of the wing element and towards the tip thereof, to reinforce and rigidify the wing element.

18. A slider as claimed in claim 17, wherein the wing-biasing means and the ties are attached to said holder.

19. A slider as claimed in claim 18, wherein the wing-biasing means comprises at least one elastic band or other elongate elastic element attached to the frame.

20. A slider as claimed in claim 1, wherein the article-support means, when in its operative, article-support position, is adapted to trap a toy parachute or other article to be dropped, in a folded condition, between the support arm and the underside of the frame.

21. A slider as claimed in claim 10, wherein at least the support means is arranged at or adjacent the rear of the frame, and is arranged to support a toy parachute, or other article to be dropped, towards, at or adjacent, the rear of the frame, thereby to minimize the load on the loop of the trigger member.

22. A slider as claimed in claim 1, wherein the wings and/or control lever and/or support means are resiliently snap fitted to their associated journals on the frame, to facilitate assembly of the slider.

23. A kit of parts for assembling a slider for ascending and descending the string of an airborne kite or the like, comprising: a frame; two wings adapted to be pivotally connected to the frame for movement between an operative position in which they are mutually spread apart on opposite sides of the frame, and an inoperative folded position; wing-biasing means adapted to resiliently bias the wings towards their inoperative folded position; support means adapted for supporting a parachute or other article to be released from the slider the support means being adapted to be connected to the frame and to be movable between an operative article-support position and an inoperative, article-release position; and latch means adapted to be operable effectively simultaneously to release the wings and support means, to permit them to move towards their inoperative positions, said latch means including an element of wire or the like adapted to be connected to the frame for displacement between a latching condition in which the wings and support means are released to move to their inoperative positions, the wire element being provided with a trigger member including a loop forming suspension means adapted for slidably suspending the slider from a kite string, and being provided with a latch member, the wire element adapted to be displaceable from its latching to its unlatching condition when the suspension loop engages an obstruction associated with the string of an airborne kite, whilst slidably suspending the slider from the string, as the slider ascends the string, means being provided adapted to resist inadvertent displacement of the wire element from its latching to its unlatching condition, said latch means further including a control lever adapted to be pivotally connected to the frame and to be connected to the wings, the latch member, in the latching condition of the wire element, adapted to be cooperable with the control lever to latch it in a first pivoted position in which it retains the wings in their operative spread position, the latch member, in the unlatching condition of the wire element, adapted to release the control lever for pivotal movement permitting the wings to move to their inoperative folded condition under the influence of the wing-biasing means, the control lever, when in its first pivoted position, adapted to be cooperable with the support means to retain the latter in its operative, article-support position, and, when released, adapted to free the support means for movement to its inoperative, article-release position.

24. A slider for ascending and descending the string of an airborne kite comprising: a generally rectangular, planar, openwork frame including, relative to the orientation which the slider is normally intended to assume when ascending a kite string, front and rear frame members interconnected by top and bottom frame members, the frame members being moulded integrally from a synthetic plastics material; first and second loops attached to the frame and projecting upwardly of the top frame member adjacent the front and rear of the frame respectively, for receiving and slidably cooperating with a kite string to suspend the slider therefrom; a wire element formed from a length of relatively rigid wire so as to comprise a straight intermediate portion journalled with respect to the front and rear frame members for sliding movement in the fore-and-aft direction of the frame, a front portion bent up from the wire forwardly of the front frame member, and provided with said first suspension loop at its upper end, and a rear portion bent down from the wire rearwardly of the rear frame member, the lower end portion of the rear portion being bent back towards the front portion, generally parallel to the intermediate portion, and passing through and slidably journalled with respect to the rear frame member, said lower end portion forming a sear which is displaceable from a latching position in which it is extended forwardly of the rear frame member to an unlatching position in which it is retracted rearwardly relative to the rear frame member when the wire element is rearwardly displaced relative to the frame upon engagement of the first suspension loop with an obstruction associated with a kite line as the slider ascends the latter; a pair of wings comprising wing elements disposed in a generally upright plane and attached to and reinforced by wing holders, connected to the frame by means of pegs fixed to the frame adjacent to upper and lower ends of the front frame member, for pivotal movement of the wings about a generally upright axis, between an operative position in which the wings are spread apart on opposite sides of the plane of the frame, and an inoperative position in which the wings are folded together adjacent the plane of the frame; at least one elastic element operable to bias the wings from their operative spread position towards their inoperative folded position; a control lever connected to the bottom frame part for pivotal movement about a generally transverse axis and connected by ties to the wings, the control lever being pivotable between a first position in which it is directed generally rearwardly and holds the wings in their operative spread position, and a second position in which the control lever is directed generally forwardly and allows the wings to be displaced towards their inoperative folded positions by the or each elastic element, the control lever being latchable in said first position by cooperation with the sear when in its latching position; and a support arm disposed below the bottom frame member and connected thereto for pivotal movement about a generally transverse axis between an upper operative position in which it is operable to trap a toy parachute or other article between the support arm and bottom frame member, and a lower inoperative position to release and drop the article from the slider, release of the support arm to pivot from its operative towards its inoperative position being effected by pivotal movement of the control lever from its first position, when the sear is retracted from its latching to its unlatching position.

* * * * *